US005583326A

United States Patent [19]

Sors

[11] Patent Number: 5,583,326

[45] **Date of Patent: *Dec. 10, 1996**

[54] PNEUMATIC ELEVATOR BY DEPRESSURE

[76] Inventor: Carlos A. Sors, Av. Pedro Zanni 1507, Parana Pcia. de Entre Rios, Argentina

[ * ] Notice: The term of this patent shall not extend beyond the expiration date of Pat. No. 5,447,211.

[21] Appl. No.: 279,998

[22] Filed: Apr. 3, 1995

Related U.S. Application Data

[63] Continuation-in-part of Ser. No. 990,124, Dec. 14, 1992, Pat. No. 5,447,211.

[30] Foreign Application Priority Data

Jan. 8, 1992 [AR] Argentina ..... 321603
Nov. 20, 1992 [AR] Argentina ..... 323709

[51] Int. Cl.[6] ..... B66B 1/04

[52] U.S. Cl. ..... 187/277; 187/414; 187/285; 187/273; 472/131; 182/48

[58] Field of Search ..... 187/273, 277, 187/414, 285, 288; 182/48; 472/131

[56] References Cited

U.S. PATENT DOCUMENTS 3,066,761 12/1962 Behrens et al. ..... 187/1
3,318,418 5/1967 Kilpatrick ..... 187/17
3,641,707 2/1972 Kellos ..... 49/462
3,949,953 4/1976 Hopkins ..... 243/3
4,023,500 5/1977 Diggs ..... 104/138 R
4,545,574 10/1985 Sassak ..... 272/6
4,948,303 8/1990 Good ..... 406/186
4,986,041 1/1991 Prewer et al. ..... 52/79.5
4,997,060 3/1991 Sassak ..... 182/48
5,354,233 10/1994 Mandy et al. ..... 454/68
5,407,029 4/1995 Salmon et al. ..... 187/340
5,447,211 9/1995 Sors ..... 187/277

*Primary Examiner*—Robert Nappi
*Attorney, Agent, or Firm*—Kuhn and Muller

[57] ABSTRACT

Pneumatic vacuum lift elevator, in which the vertical shaft is a tube with smooth interior surface, preferably cylindrical, with straight axle, and the transport cab or vehicle moving inside such tube is a piston with vertical movement, with minimum play inside the tube, equipped with air suction devices at the upper end of the tube, capable of causing a sufficient pressure differential to displace such piston in controlled ascending and descending movement; completed with an air entry or intake in the lower end of the tube, and the access doors with which the tube is equipped, and which are hermetically closed on the various stopping levels.

4 Claims, 3 Drawing Sheets

FIG. 3
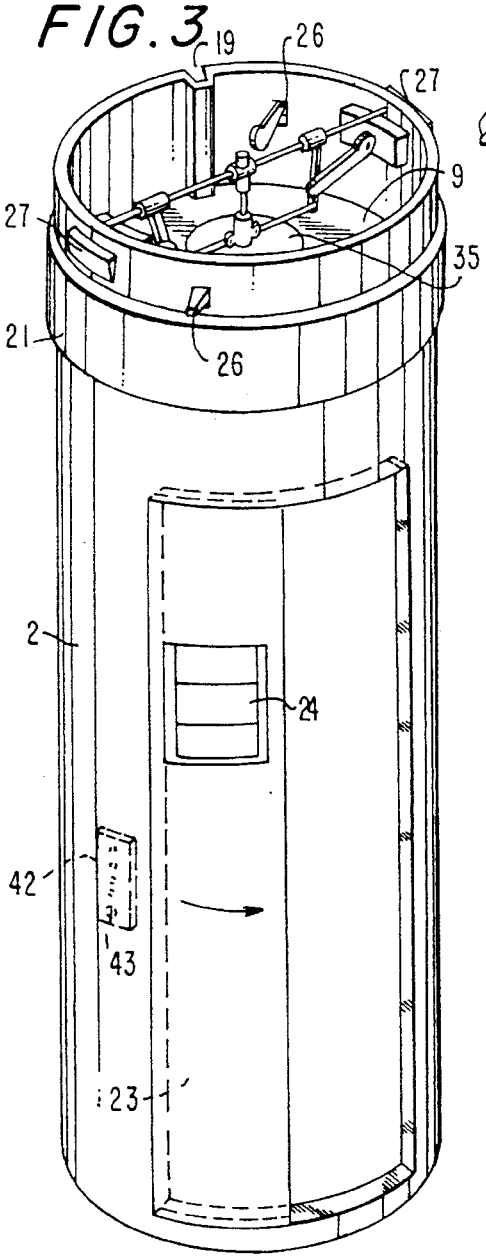
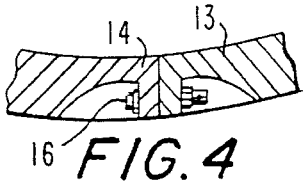
FIG. 4
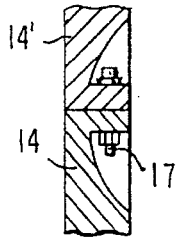
FIG. 5
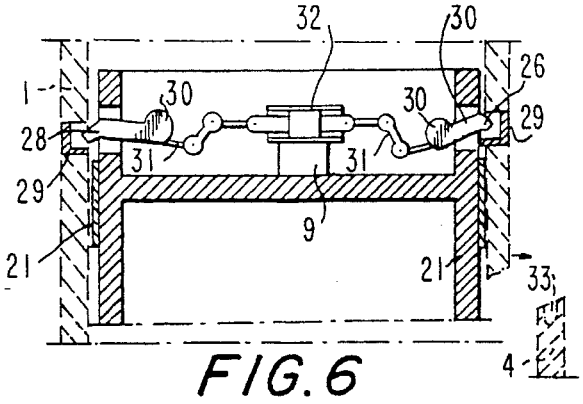
FIG. 6
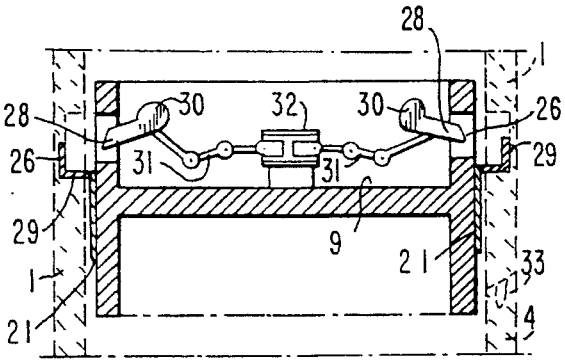
FIG. 7
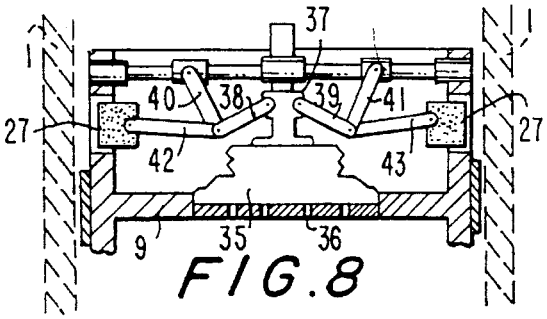
FIG. 8
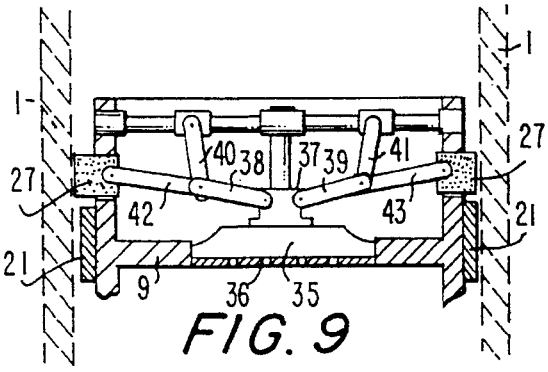
FIG. 9

PNEUMATIC ELEVATOR BY DEPRESSURE

This application is a continuation-in-part of application Ser. No. 07/990,124 filed Dec. 14, 1992 now U.S. Pat. No. 5,447,211.

I. GENERAL—PREVIOUS ART

The main object of this invention patent is an elevator, hoisting persons, animals or things, with the main basic novelty that it functions pneumatically by vacuum lift, and consequently presents numerous advantages over other vertical transport devices known to date.

More specifically, this invention patent covers an elevator of the specified type, pertaining to the category of those made up of a combination of vertical shaft and moving transport vehicle located inside the shaft, connected to devices capable of causing ascent and descent between the upper and lower ends, including the corresponding doors and optional intermediary stops for transfer between the vehicle and the various floors, the whole device being equipped with operation and safety means, as well as means to keep such vehicle braked while stopped at the level of an open door.

Various constructive and functional variations of this type of devices are known; noteworthy among them are those in which the vertical movement of the cab, or moving vehicle, uses cables which twist around a drum or pulley, operated by a motor, usually electrical; as well as those employed for the same purpose, using vertical racks engaging the teeth of gears operated by a motor, generally located above or below the cab, requiring shorter cables since, if cables are used, they are used only for counterweights.

(A) Other designs exist, which use pneumatic means to obtain the shifting of "cabins," "cars" or bodies through the interior of tubes. It is possible to cite, as examples: G. G. Good U.S. Pat. No. 4,948,303, Aug. 14, 1990, relating to a pneumatic tube carrier, in which a special cylindrical container for receiving pneumatic pressure, with two circular flanges (6) at its ends, is shown. It is explained that this container is not suitable for transporting persons, since it lacks means to assure atmospheric pressure in its interior;* W. C. Kilpatrick U.S. Pat. No. 3,318,418, May 9, 1967 discloses a pneumatic elevator installation wherein a car moves as a piston vertically within a hoistway in response to pneumatic pressure existing in the hoistway beneath the car between a lover love /sic/. L. A. Hopkins U.S. Pat. No. 3,949,953, Apr. 13, 1976, discloses fluid propelled transporters which are propelled along a duct by a fluid pressure force; R. E. Diggs U.S. Pat. No. 4,023,500, on May 17, 1977, discloses a high-speed ground transportation system wherein a vehicle rides on a film of air and is propelled as a free piston through a tunnel by pneumatic pressure; J. J. Sassak U.S. Pat. No. 4,545,574, discloses a Fluid Suspended passenger Carrying Spherical Body Having Universal Attitude Control, comprising a spherical passenger-holding body having closure means lower opening and which is mounted above the base for receiving the body as it is being raised from said lower position, to guide the body along a predetermined upward path of motion defined by the tube; J. J. Sassak U.S. Pat. No. 997,060, discloses an Apparatus for Controlling the Descent of a Passenger-Carrying Body, comprising: chute means, including a wall having an upper end and a lower end; a passenger-carrying body disposed in the chute for falling through it under the influence of gravity toward the lower end of the chute at a first rate of descent; first means for closing the chute means below the passenger-carrying body, so that the falling body compresses the air beneath the passenger-carrying body to form a cushion; means for increasing the speed of the passenger-carrying body during a part of its descent toward the lower end of the chute below the passenger-carrying body, for passing air from the chute; air motor means in said opening for removing air from beneath the passenger-carrying body as it is descending, to increase the speed thereof, so as to be greater than said first rate of descent; CH. I. Matson U.S. Pat. No. 817,381, on Apr. 10, 1906, discloses a Gondola Mounted on a Piston; the piston is supported in a vertical shaft, and is raised and lowered by compressed air. The gondola is lowered until the piston cuts off the escape of air from the shaft through a conduit, at which time the confined air below the piston acts as a spring or cushion to gradually retard its motion and bring it to a full stop.

As indicated in the prior art cited above, the use of pneumatic functioning principles to shift cars or cabins through the interior of tubes or ducts is known. Various patents of invention relating to different applications of these functioning principles have been granted.

II. NOVELTY OF THE INVENTION

The aforementioned vertical shaft consists of a tube, preferably cylindrical, with substantially smooth internal surface, while the transporting vehicle consists of a cab which, having similar shape and being coaxial to the shaft, has a roof or upper plate containing a coaxial piston, capable of moving with minimum friction and reduced resistance to vertical sliding, while the aforementioned device capable of inducing ascent and descent of the cab consists of means for establishing, controlling and regulating a differential between atmospheric pressure and the lower pressure created in the space between the piston, the lateral walls of the shaft and its lower end; therefore, the interior of the cab and the portion of the shaft located underneath the piston, are also at atmospheric pressure.

This pressure differential constitutes the fundamental basic novelty of this invention, because it causes a suction effect which tends to lift the piston from inside the shaft. This effect is used by this invention, which has an air aspiration device capable of generating a pressure lower than atmospheric pressure. On the other hand, such pressure differential is controlled by an air inlet system at the hermetic space of the shaft above the piston; such system is controlled by a valve located adjacently to the aspiration motor. This valve is kept closed by the action of an electromagnet which closes it when the aspiration motor is extracting air to make the cab ascend. When open, it allows air entry, so that the pressure differential causes the cab to descend at a speed of one meter per second, which is the norm for elevators.

The same aspiration can be obtained by numerous different methods, regardless of the particular resources used, provided that, in the front part of the enclosure, which is of variable height, an air aspiration device is installed, properly controlled and commanded, indistinctly, both from the interior of the cab and from the exterior of the shaft inside which the cab moves.

Obviously, in the upper enclosure, which is of variable height, minimum air-tightness conditions must be assured, at least partially extending to the doors providing access to the shaft at the various stopping levels of the cab.

To obtain low pressure inside the variable height enclosure, it is convenient to locate the air aspiration device at its upper end. Such aspiration device may be a simple turbine, a vacuum motor or suction device, a mechanical aspirator or similar device that may be individually known, so that such device, although it is indispensable for operation, does not affect the novelty of this invention patent; even more so, if we take into consideration the fact that the same purpose may be served by using a tube with a rigid or flexible end, connected at its other end to any aspirator with appropriate power, installed at the most convenient location. The basic condition is the presence of an air aspiration device.

Concerning the means for keeping the cab braked at various levels on its ride, the conventional solutions employed in other known elevators may be used, as well as others, using the pressure differential. The same is true concerning the command, call, stopping and speed setting means.

It may be concluded from the above that the pneumatic elevator made up solely of a vertical shaft, a moving vehicle inside the shaft, an element for air aspiration from above and command means, is extremely simple and eliminates the need for traction cables, pulleys, counterweights, gears, racks, etc., which require significant, permanent, costly maintenance; at the same time, the respective construction can be made with very light, economic materials, quite easy to purchase, transport and assemble.

It is noteworthy that the main object of this invention consists of a pneumatic elevator operated by vacuum lift, of the type made up of a vertical shaft or passage, inside which there is a transport cab, installed so that it may move, linked to means capable of causing ascent and descent for the transport of persons or freight between floors at various levels, in which the shaft has its respective access doors; whereby the shaft is made of a tube with smooth interior and straight axle, while the transport cab is coaxial with the former, leaving a narrow free space between the two which, at cab roof level, closes by means of a sliding, air-tight mechanism surrounding the cab, forming a piston in friction contact with the internal surface of the shaft and submitted to the action of the device capable of causing ascent and descent, made up of an air aspirator located at the upper end of the vertical shaft and an atmospheric air intake located at the lower end of the shaft.

As first option, it is considered that the straight-axle shaft and the coaxial cab are cylindrical, with circular cross section.

On the other hand, the vertical shaft can be equipped with hermetic closing devices, along the frame of each door, creating air-tight wedges at the corresponding perimeter frames.

Equally, it is planned to equip the cab with direct air openings communicating with the interior of the shaft, located under the perimeter roof level trim.

In order to hold the cab during stops, it is convenient to equip it with mechanical lock devices, at the various intermediary stop levels, inserted in the respective support cavities, located across from each other in the vertical cylindrical shaft, capable of temporarily maintaining the cab in place.

Each locking device consists of an offset beam and counterweight with one end jutting out across the wall of the cab, squared with an extension able to penetrate a corresponding support cavity located in the cylindrical tube; such beam is operated by an electromagnet connected to the electric command system of the aspiration motor.

In addition, the cab has braking devices limiting descent speed. Such braking devices consist of shoes, located across from each other, which can be moved towards the internal surface of the vertical shaft, by action of a diaphragm located in the roof of the cab, operated by the pressure differential of the air contained in the cab and the upper space located between the roof of the cab, the interior of the shaft and its upper end.

In addition, the experimental tests conducted have demonstrated that energy consumption for operation is muck lower than that required for all other types of elevators known to date.

The novelty in this case, i.e. the difference, is that the cab uses neither pneumatic pressure nor an air current for its motion.

The special nature of this invention compared to the others is that up or down movements of the cab are the result of the increase or reduction in pneumatic pressure to values which are always below the atmospheric pressure. In addition, these changes in air pressure (below atmospheric pressure) are created only in the upper area of the variable volume between the cab roof, the walls oft he vertical duct and its upper end. Another distinguishing characteristic of this invention is that the lower area of the variable volume, between the cab roof, the walls of the vertical duct and its lower end, is permanently maintained under atmospheric pressure.

In order to meet the operating conditions and characteristics listed in the preceding paragraph, a purpose of this invention is to provide a pneumatic elevator which meets the following basic construction characteristics: a) the vertical duct is closed at the top and a device is located there to draw the air into the upper portion of the variable volume, where the pneumatic pressure is below the atmospheric pressure, creating a chamber under negative pressure; b) a flexible, circular band glides around the cab roof and acts as a hermetic seal which separates and insulates this upper area from the lower area of the variable volume; c) inside the vertical duct under the flexible circular band, the lower area with variable volume is created under the hermetic seal, between the cab roof, the walls of the vertical duct and its lower end, where the pneumatic pressure equals the atmospheric pressure; it is inside the cab, connected to said lower area; d) in the same upper area there is also a valve element which makes it possible to regulate the air recovery system in said upper area of the variable volume; e) an additional purpose of this invention is to provide, in the cab roof, a diaphragm which controls braking devices which act on the walls of the vertical tube when the air pressure in the upper area equals the atmospheric pressure and thus is balanced with respect to the atmospheric pressure which is always maintained in the lower area under the cab roof, including the inside of the cab where the passengers are seated. f) an additional purpose of this invention is to provide in the cab roof many devices for mechanical locks which can be inserted into diametrically opposite support openings provided in the thickness of the vertical tube; g) an additional purpose of this invention is that the vertical tube has openings whose bordering edges form a hermetic seal with the bordering edges of the corresponding doors, so that a hermetic seal is obtained when the pressure inside the tube is below the atmospheric pressure outside the tube.

III. SHORT DESCRIPTION OF THE DRAWINGS

To illustrate the summarily explained advantages of the invented elevator, to which users and specialists may add many others, and to facilitate understanding of its constructive, constitutive and functional characteristics, below is a description of a preferred example of realization, schematically illustrated in the enclosed figures, without a determined scale, with the express clarification that, precisely since this is an example, it should not be attributed limitative, exclusive or conditioning character for the protection scope of this invention patent; its purpose is merely explanatory or illustrative for the basic design on which the invention is based.

FIG. 3 is a perspective view of the movable cab or freight vehicle which ascends and descends vertically inside the external shaft.

. FIG. 4 is a sketch, at enlarged scale, of the vertical connection between the sections making up the external shaft.

FIG. 5 is a similar sketch of the horizontal connection between successive superposed sections of the shaft.

FIG. 6 is a cross section of the upper part of the cab, where only the locking devices thereof are indicated when the cab is stopped on a floor, whereby other devices were eliminated in order to make the drawing clearer.

FIG. 7 is a repetition of the prior figure, where the aforementioned devices are shown in unlocked position.

FIG. 8 is another section of the upper part of the cab, including only the braking devices with the cab in free movement.

FIG. 9 is a repetition of the prior figure, where the aforementioned devices are in braking position.

In all the figures, the same reference numbers are matched by the same or equivalent parts or elements of the prototype selected as example for the present explanation of the pneumatic elevator invented.

IV. DETAILED DESCRIPTION OF THE EXPLANATORY REALIZATION EXAMPLE

Figure 1:
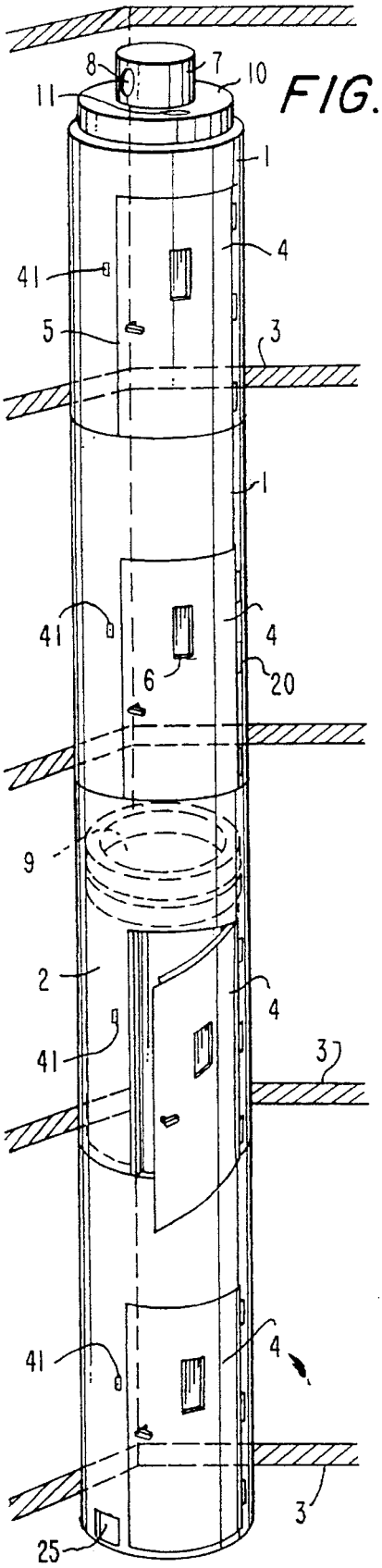
FIG. 1 is a perspective sketch of a pneumatic elevator operated by vacuum lift, according to this invention, connecting a ground floor with three stories.

As can be seen in FIG. 1, the pneumatic elevator operated by vacuum lift illustrated therein includes, in the first place, an exterior tube —1— or shaft which, in this case, is cylindrical with round base, containing a mobile cab —2—, also cylindrical, with a slightly smaller diameter, to be able to move vertically in the interior of the shaft. These shapes can have other cross sections, i.e. rectangular, ellipsoidal, etc.; the material may also be of any type, the convenient materials being modern plastics, such as fiberglass-reinforced epoxy resin, the same as steel plates installed in the walls of the tube and cab.

This tube —1— is made up of several coaxial modules, preferably up to 3,000 millimeters long, according to needs. Each of these cylindrical modules is connected to the contiguous ones by bolts, shown in detail in FIGS. 2, 4 and 5, complemented with a sealed joint made of silicone rubber.

Figure 2:
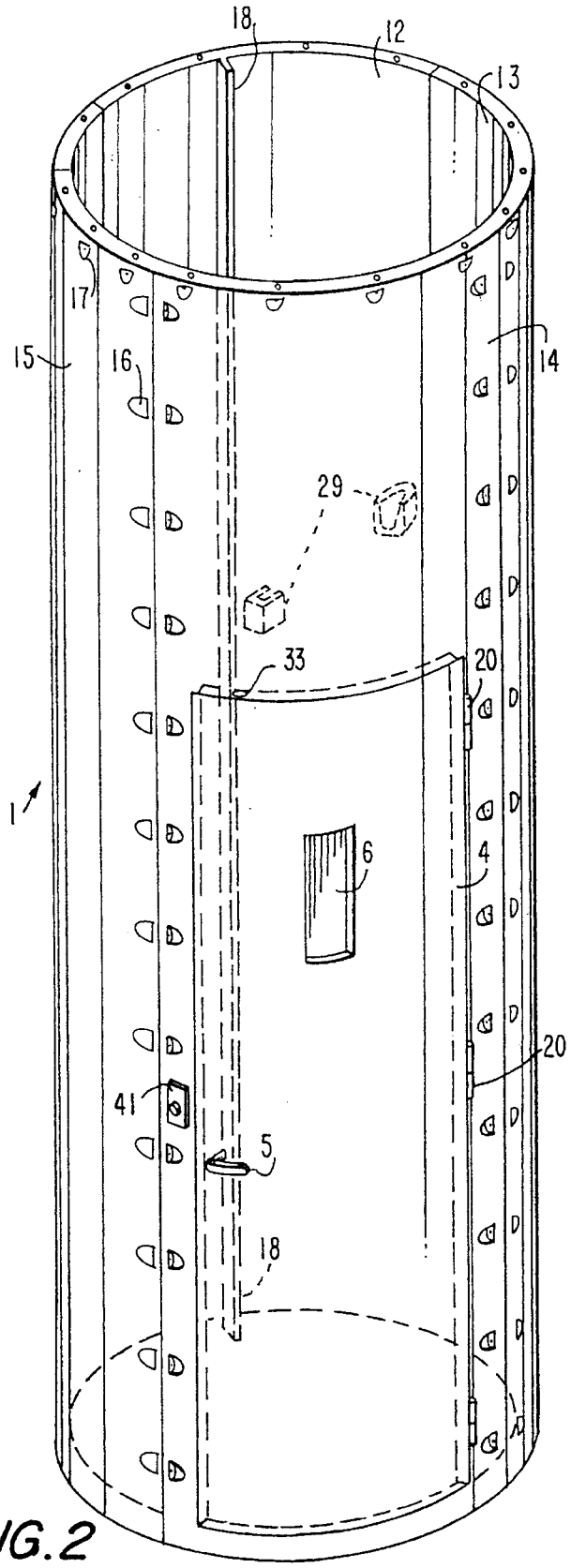
FIG. 2 is a perspective portion, at larger scale, of the tubular shaft of the elevator appearing in the preceding figure.

In addition, in this example as well, each cylindrical module or section is made of four sections which are more clearly seen in FIG. 2, or circular sections with the same diameter, also connected with bolts and sealed joints.

FIG. 2 shows that, at each floor level —3— there is a substantially hermetic door —4—, preferably with wedge-shaped frames to assure air tight closing preventing air penetration inside the tube, generally at low pressure, as explained below, and which may be complemented with rubber or similar trimming.

The aforementioned doors are hinged on one of their sides and equipped with door knob —5— and a peephole —6— to facilitate observation from the interior of the tube or shaft.

In the upper end of this shaft there is an aspiration element —7— which, as already said, can be an electric turbine fed by a conductor cable, not illustrated, with an outlet —8— for the air it absorbs from the interior of the space formed inside the shaft and above the roof —9— of the cab —2—.

The aforementioned aspiration motor assembly is located above the upper plate —10— of the shaft, in which there is a regulating valve —11— allowing to control air inflow to the aforementioned space, regardless of the suction performed by the turbine.

Observing FIG. 2, we can see the four vertical sections with semi-circular cross section, indicated by references —12—13—, —14— and —15—, which form a vertical module, partially aligned with other similar ones. The respective connections between successive sections and successive modules, besides being sealed with hermetic joints, are adjusted by pins or bolts, such as those schematically indicated, with references —16— and —17—, in FIGS. 4 and 5, where the portion of the module located over portion —14— of the module immediately below it is marked —14'—.

FIG. 2 also illustrates the installation of a door —4— with its door knob —5—, the peephole —6— and the hinges —20—, as well as a vertical internal guide —18— extending all along the shaft to prevent the cab from gyrating, equipped with a "U"-shaped skid —19— on its external surface.

In turn, since the four sides of the door —4— are wedge-shaped, the internal suction lift in the aforementioned upper space creates a pressure differential with the surrounding or external atmosphere, producing hermetic closure indispensable for the good operation of the whole.

The cab —2—, illustrated in detail in FIG. 3, also has circular section in this case, with cylindrical circumference wall, with an outside diameter of 1226 millimeters, while the internal diameter of the tube —1— is 1234 millimeters. This diameter difference of the cab leaves room for a perimeter seal —21—, 220 millimeters high and 5 millimeters thick, surrounding the upper part of the cab, which is the part located above the door —20— of the cab, in this case a sliding panel.

If, in the upper aspiration motor —7— an effort is applied creating a vacuum lift on the order of 300 millimeters water column which, in a tube with 1-mm section, is equivalent to 30 grams/cm2, repeated at the same value on the entire horizontal surface of the piston or cab roof, which in this case has 1234 millimeters diameter, the total ascending force will be close to 358 kg; this force is sufficient to make the cab ascend with all its own weight plus the weight of three persons, or more, depending on the material of which the cab is made. If larger weights need to be hoisted, the suction lift may increase significantly, since this value (300 mm water column) is approximately 1/30 of the normal atmospheric pressure.

The aforementioned perimeter seal —21— is made up of a textile carpet of synthetic material similar to floor carpets, which is partially compressed between the internal surface of the tube —1— and the external surface of the cab or piston, creating hermetic sealing for the pneumatic effect arising from the pressure differentials/line missing in original/ . . . perimeter seal —21—, the pressure in the interior of the tube is atmospheric, also extended towards the interior of the cab and underneath it. For this purpose, the cab has openings such as shown under —24—, in its sliding panel —23—.

The lower module of the tube has at least one opening —25— providing permanent air intake under the cab, when the cab is either ascending or descending, as illustrated in FIG. 1.

In the upper part of the cab —2— and above its roof —9—, there is a cylindrical extension with its upper plate open and partially surrounded by the aforementioned hermetic carpet trimming —21—. In the peripheral walls of this extension there are devices which maintain the cab in its stopped position on the corresponding floors and also safety devices against possible unintentional descent. Such devices consist of the locks —26—, which must be two, across from each other, as illustrated in FIGS. 6 and 7, and also, partially, in FIG. 3, and the brake shoes —27—, also across from each other and illustrated in FIG. 3 and FIGS. 8 and 9.

The locks —26— which maintain the cab stopped, consist of offset beams, articulated in —28—, which protrude with short arms able to penetrate and fit the respective hollow supports —29—, located across from each other, installed in the thickness of the external tube. Each beam is solid with a counterweight —30— located inside, which press outwardly the aforementioned locks —26— and lean on squared levers —31—, operated by central electromagnets —32—. Such electromagnets are able to lift the counterweights —30— and release the locks —26— from the cavities —29—, so that the cab may move freely.

One of the hollow supports —29— is positioned vertically, across from the opening end of the exterior door —4—, which has, as illustrated in FIG. 2, an orifice —33— in its upper frame side, into which a non-illustrated bolt can penetrate; the latter descents under the action of the corresponding beam —26—, in order to maintain the door closed while the beam is in the position in which it releases ascent and descent. FIG. 6 shows the door ajar, with its orifice —33— outside the reach of the non-illustrated bolt, when the beam —26— is in locking position. In exchange, FIG. 7 shows the aforementioned orifice —33— in condition to allow the entry of the aforementioned bolt, since the beam —26— is unlocked and remains twisted by the effect of the counterweight —30—.

The brake device made up of the two shoes —27— is linked to the control diaphragm —35—, partially visible in FIG. 3 and illustrated in two operating positions in FIGS. 8 and 9, namely free movement and braking, respectively. In the first position, the diaphragm expands, causing the retraction of the shoes —27— away from the lateral walls of the external tube. In exchange, when the diaphragm contracts, the shoes are pushed towards the lateral walls, causing braking.

The first position of the brake shoes is when the pressure differential between the upper space of the tube and the interior of the cab is effective; while the second position corresponds to equal pressure in the space and the cab.

For the expansion and retraction of the diaphragm —35—, the orifices —36— are included; their inner part communicates with the interior of the cab, at atmospheric pressure.

The central part of the diaphragm is solid with a vertically moving part —37—, connected to two connecting rods —38— and —39—, respectively operating levers —40— and —41—, which move the shoes —27— through the connecting rods —42— and —43— into their operating position explained above.

The brake shoes —27— are maintained away from the walls of the tube during the descent of the cab, due to the pressure differential limiting the cab's descent speed, which is controlled by the inflow of air into the upper hermetic space of the assembly and which, as already explained, is regulated by a valve —11— located in the upper plate —10— of the tube, next to the aspiration motor —7—. The valve remains closed by the action of an electromagnet, not illustrated, which commands it when the aspiration motor is purging air through the orifice —8—, in order to move the cab. In open position, it provides an air inflow so that the pressure differential allows the descending cab to move at a speed of one meter per second; this being the usual speed of traditional elevators, as already explained.

The electrical control installation of the aspiration motor —7— is made up of calling buttons —41— on each floor and a button pad —42— inside the cab, equipped with a button for each stop or floor, all with their corresponding conventional connection cables. Furthermore, a conventional emergency stop button —43— is also found in the cab.

Calling buttons are intercalated in a serial electrical circuit, with micro switches and connectors which, located in the access doors —4— and cab —2—, are connected only when the doors are closed, thus preventing the aspiration motor from operating when any door is open. When connected, the aspiration motor —7— stays connected, since it is in parallel with the electromagnet which closes the valve located under —11— on the tube plate, allowing air inflow for the descent of the cab.

This circuit is completed by a floor selector system, which does not affect the novelty of the invention, since it is known, being similar to those used in traditional elevators; it stops the aspiration motor and operates the locks when the cab arrives at the corresponding floor selected with the calling button. The locks —26— which keep the cab still are moved by their own weight when, due to an electric failure, the electromagnet operating them stops functioning, thus assuring that the cab will stop on a floor where the door may be open, so that the occupants may get out, if needed.

Figure 10:
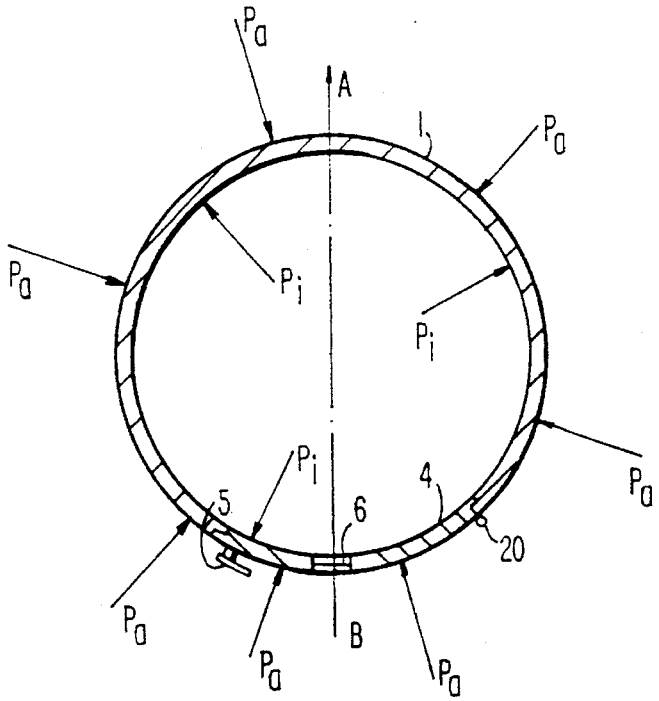
FIG. 10 is a crose section cut in a horizontal design of the tube illustred in FIG. 2.

The FIG. 10 is a cross section cut in a horizontal design of the tube —1— illustred in FIG. 2. The reference numbers are the same of those appearing in FIG. 2. It also adds the reference "Pa"—"Atmospheric pressure" and "Pi"—"Interior pressure". This figure intends to describe more / clearly what's ilustrated in FIG. 2. The door —4— obtain an hermetic closing when the "Pi" pressure in the tubes interior is smaller than the atmospheric pressure "Pa" outside the tube.

Figure 11:
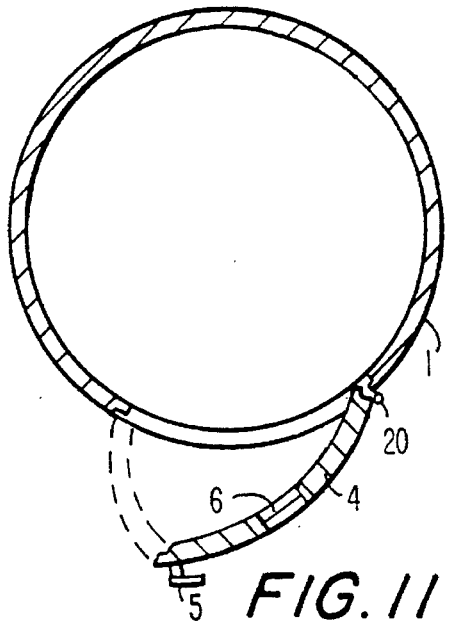
FIG. 11 is a cross section cut similar to the one in FIG. 10, but in this case with the door open.

The FIG. 11 is a cross section cut similar to the one in FIG. 10, but in this case with the door —4— open.

Figure 12:
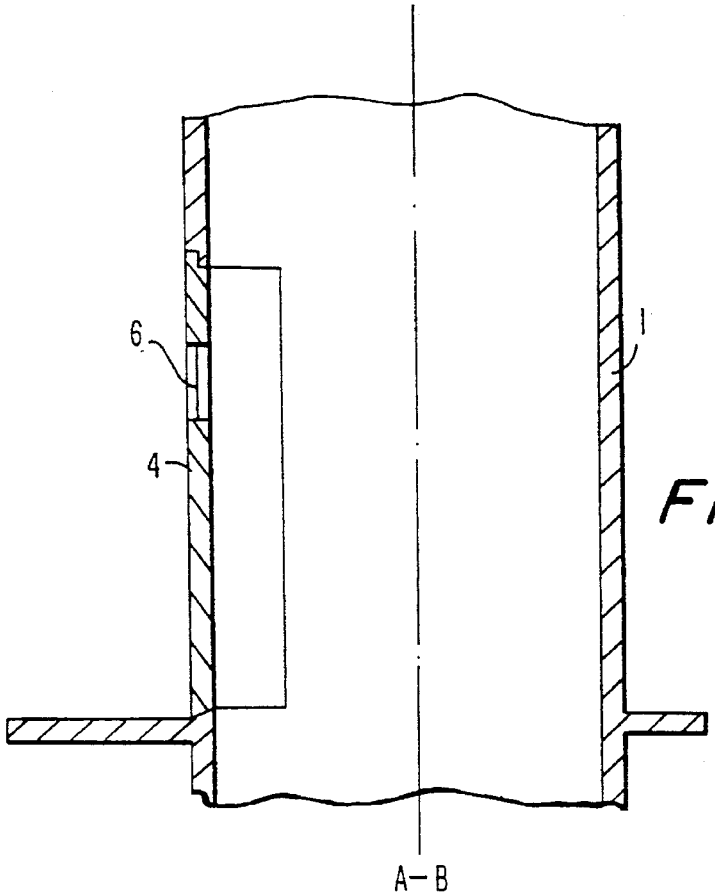
FIG. 12 is a vertical cut according to design A-B indicated in FIG. 10.

The FIG. 12 is a vertical cut according to design A-B indicated in FIG. 10. Those figures allow understanding of the perimetral edges shape of the tube's opening and their corresponding doors —4—. That means, this invention uses the interior depressure in a way that causes the proper atmospheric exterior pressure to act on the heretic look of the door —4—.

V. OPERATION

The pneumatic elevator by vacuum lift, explained for the example above, operates in the following manner.

Supposing that the cab —2—, illustrated in FIG. 1, is closed with the corresponding door —4— in the position shown in FIG. 2, operating electrical contact is established for the upper suction element —7—, thus creating a uniform vacuum lift which, as indicated when explaining dimensions, may be in the range of 300 kg for ascent, and may increase when the vacuum lift is increased, as needed.

When the cab ascends, the lower part of the tube —1— is filled with air at atmospheric pressure, preferably penetrating through the lower entry or intake —25—, to the hermetic trimming —21— surrounding the piston constituted by the roof of the cab. Air also enters through the window —24— installed in the cab, or possibly a telescopic bar door, replacing the illustrated door —23—.

To cause descent of the cab, one of the most direct methods may consist of releasing an upper air intake into the tube —1—, above the cab, through the valve —11— located across from the opening controlled by the electromagnet, or also closing the suction element —7— and letting air enter through this element, or by any other means, which should preferably be operated and controlled by the braking device.

When vacuum lift decreases, the ascent force will decrease, until it is exceeded by the weight of the cab, in order to cause descent, during which the air will flow out freely through the lower intake or opening —25—.

I claim:

1. A negative pressure elevator comprising:

a) a vertical duct closed at the top and having various stopping levels along the length of said vertical duct;

b) cabin means having a roof movable within said duct for carrying passengers and/or freight up and down from one stopping level to another stopping level and forming an upper enclosure portion within said duct between said cabin means and the top of said vertical duct;

c) means for maintaining atmospheric pressure in said duct below said cabin means;

d) suction means located in the top of said duct above said cabin means for maintaining a pressure below that of atmospheric pressure within said upper enclosure portion and for varying said below atmospheric pressure within said upper enclosure portion to move said cabin means up and down within said duct between said stopping levels;

e) seal means comprising a flexible annular band on and attached to the outside of and adjacent to the roof of said cabin means for making sliding contact with the inside wall of said duct to isolate said upper enclosure portion from the lower portion of said duct below said seal means, said upper enclosure portion being bounded on the bottom by the roof of said cabin means and said flexible annular band;

f) means for maintaining atmospheric pressure within said cabin means by providing continuous communication between the interior of said cabin means and the lower portion of said duct below said flexible annular band; and g) electronic command means for controlling said suction means to move said cabin means from one stopping level to another stopping level within said duct.

2. The pneumatic elevator of claim 1 wherein said duct is provided at each of the stopping levels with support cavities and said cabin means is provided with mechanical locking means to engage said support cavities to temporarily hold said cabin means in place when at a stopping level, said mechanical locking means including offset beams each having a counterweight with one end jutting out from a wall of said cabin means and engaging one of said cavities, said beam being operated by an electromagnet connected to said electrical command means.

3. Pneumatic elevator, according to claim 1, where the vertical duct includes door openings that have perimetral edges forming hermetic wedges with the perimetral edges of the corresponding doors, obtaining a hermetic closing when the pressure in the interior of the duct is less than the atmospheric pressure outside the duct.

4. The pneumatic elevator of claim 1 wherein said duct and cabin means are circular in crossection, and said duct includes means to prevent said cabin means from rotating during movement comprising a vertical guide mounted on and projecting from the inside surface of said duct and said cabin means having a vertical U-shaped groove on the outside thereof, said groove engaging said guide.

* * * * *